US006410111B1

(12) United States Patent
Roth et al.

(10) Patent No.: US 6,410,111 B1
(45) Date of Patent: Jun. 25, 2002

(54) SELECTIVE RELEASE LABEL SHEET

(75) Inventors: Joseph D. Roth, Springboro, OH (US); Wayne D. Finster, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/151,000

(22) Filed: Sep. 10, 1998

(51) Int. Cl.[7] ..... B42D 15/00

(52) U.S. Cl. ..... 428/40.1; 283/81; 428/41.8; 428/41.9; 428/42.1; 428/42.2; 428/42.3; 428/194

(58) Field of Search ..... 428/40.1, 42.1, 428/42.2, 42.3, 71.8, 41.9, 194; 283/81

(56) References Cited

U.S. PATENT DOCUMENTS

| | | | | |
|---|---|---|---|---|
| 4,410,203 A | * | 10/1983 | Lothrop | 283/81 |
| 4,771,891 A | * | 9/1988 | Sorensen | 428/41.9 |
| 5,279,690 A | | 1/1994 | Hess, Jr. et al. | 156/226 |
| 5,328,208 A | | 7/1994 | Garrison | 283/105 |
| 5,501,393 A | | 3/1996 | Walz | 229/92.8 |
| 5,580,640 A | | 12/1996 | Kraft et al. | 428/195 |
| 5,591,290 A | * | 1/1997 | Walter | 156/152 |
| 5,700,536 A | * | 12/1997 | Steidinger | 428/41.9 |
| 5,704,650 A | | 1/1998 | Laurash et al. | 283/81 |
| 5,846,624 A | * | 12/1998 | Denklau | 428/42.3 |
| 5,853,836 A | * | 12/1998 | Zoss | 428/41.9 |
| 6,217,078 B1 | * | 4/2001 | Roth | 283/81 |

FOREIGN PATENT DOCUMENTS

| | | | | |
|---|---|---|---|---|
| DE | 4418923 | | 7/1995 | |
| FR | 5050035 | * | 3/1971 | 428/41.9 |

OTHER PUBLICATIONS

Patent Abstracts of Japan, vol. 1997, No. 12, Dec. 25, 1997 & JP 09 204144 A (Sato:KK), Aug. 5, 1997.

Patent Abstracts of Japan, vol. 016, No. 514 (P–1442), Oct. 22, 1992 & JP 04 188183 A (Tatsuku Shisutemu KK), Jul. 6, 1992.

Patent Abstracts of Japan, vol. 1996, No. 03, Mar. 29, 1996 & JP 07 295474 A (Toppan Printing Co. Ltd), Nov. 10, 1995.

Wallace News & Highlights—New Product Announcements, http://www.wallace.com/news/newproducts.asp, May 13, 1999, pp. 1–2.

Rhodia, Inc., "UV–Silicone Cure System", Mar. 9, 1998, 7 pages.

* cited by examiner

*Primary Examiner*—Nasser Ahmad
(74) *Attorney, Agent, or Firm*—Francis L. Conte

(57) ABSTRACT

A label sheet includes a label joined to a release liner by an adhesive with adjacent relatively low and high release bonds. The high release bond secures the label to the liner, and the low release bond permits easy removal therefrom.

22 Claims, 5 Drawing Sheets

FIG. 7
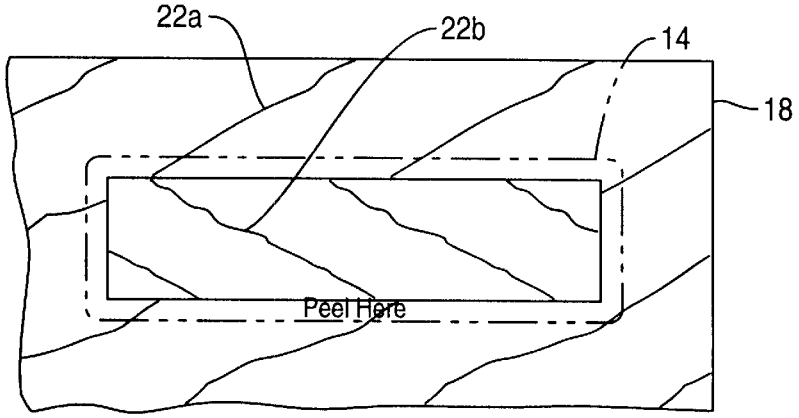
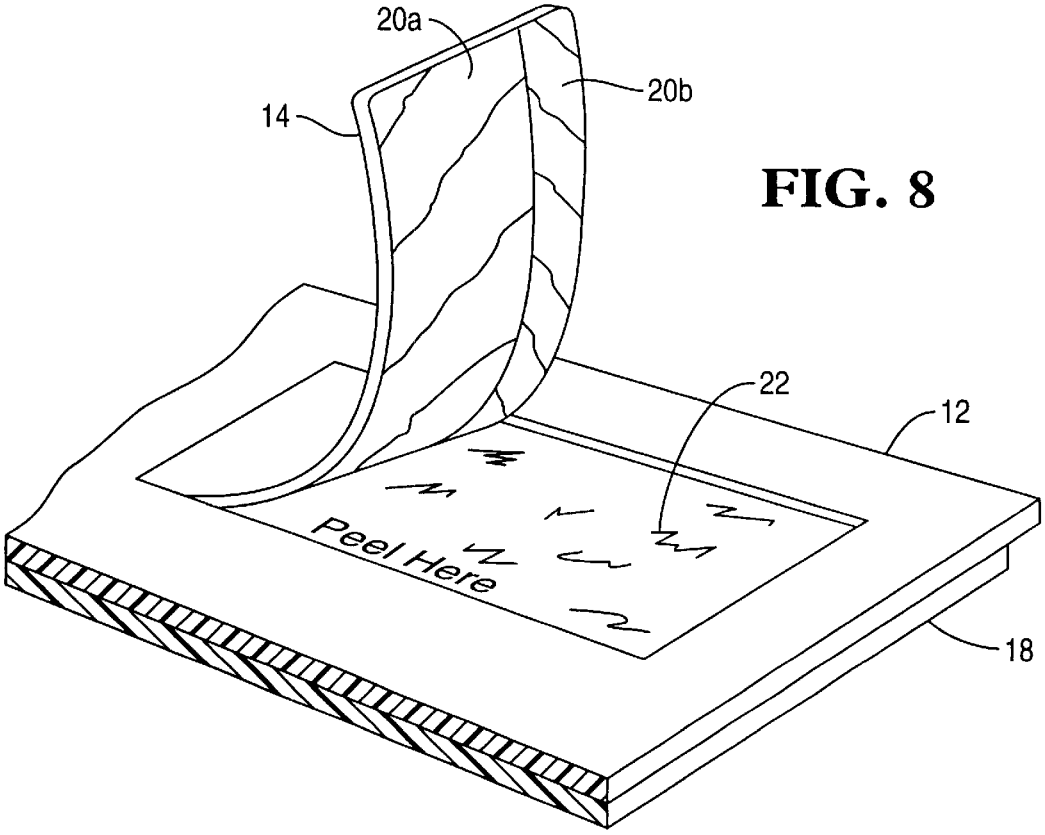
FIG. 8

SELECTIVE RELEASE LABEL SHEET

BACKGROUND OF THE INVENTION

The present invention relates generally to laminated label sheets, and, more specifically, to label integrity thereof.

Label sheets are commonly available in various configurations with and without printing thereon. A typical label sheet is a laminate of a paper overlay and an underlying release liner. An adhesive bonds the overlay to the liner in the finished article.

In typical use, information is printed atop the overlay, and the overlay is then removed from the liner by being peeled therefrom. The peeled away label has exposed adhesive so that it may be pressed against paper or other object for attachment thereto. A typical release liner is coated over one side with liquid silicone which is thermally cured for providing a low adhesion surface thereatop to which the overlay is temporarily bonded. The adhesive provides a weak bond between the overlay and the silicone liner which sufficiently maintains together the laminate until it is desired to remove the overlay from the liner.

More complex label sheets include several labels or decals in the overlay defined by respective perimeter diecuts therebetween which allow removal of individual labels from the liner. The individual labels may be directly adjacent to each other or there may be an intervening label rim or border which remains attached to the liner after the individual labels are peeled away.

A further increase in complexity of the label sheet includes an integral paper form attached to the label portion of the overlay which does not overlie the liner. This type of label sheet may be manufactured using a lap joining method wherein the label and liner laminate is premanufactured and lap joined along an edge thereof to the paper form. In another, integrated, method of manufacture, the entire overlay, including the label and form portions thereof, is separately manufactured in a common sheet and the liner is then bonded below the label portion thereof.

These various label sheets nevertheless use a commonly fabricated release liner which is typically manufactured in large rolls with the silicone in liquid form being applied over the entire surface of the liner paper which is then thermally cured. The large roll of release liner is then cut into individual smaller rolls for use in various label sheet applications as required.

The release coating may be specifically formulated to effect low to high release bonds with the overlay. In use, it is desired to have low release bonds so that the individual labels may be easily removed. This is typically accomplished by bending the label sheet near one of the diecuts to locally break the bond thereat to expose a portion of the label which is then peeled away.

However, if the release bond is too weak, individual labels may separate from the liner during their travel through a laser printer for example. A laser printer may include narrow rollers for guiding the label sheet therethrough, and also includes a fusion roller for heat curing the printing toner on the labels. The heat softens the adhesive, and the narrow rollers bend the sheet tightly which can separate the labels from the liner if insufficient release bonds are used. If a label predispenses in the printer, it not only destroys the usefulness of the label, but can damage the printer by bonding to internal components thereof.

Accordingly, the release bond is typically tailored for a specific type of label sheet and intended printer, and should be suitably high to prevent predispensing in the printer. This correspondingly high release bond increases the difficulty of manually removing individual labels when desired in use. This can be a significant problem where labels are used in large volume, such as in the pharmacy industry.

Pharmacists typically use the combined label sheet and form for recording various information in a typical pharmaceutical drug transaction which requires one or more individual labels to be removed from the sheet and attached to a prescription drug container. The use of high release bonds in a label sheet to prevent predispensing in a laser printer correspondingly increases the difficulty of removing individual labels from the sheet, and therefore increases the amount of work and time required in completing individual drug transactions.

Accordingly, it is desired to provide an improved label sheet which increases the ease of removing individual labels during use, yet prevents predispensing thereof in a laser printer.

BRIEF SUMMARY OF THE INVENTION

A label sheet includes a label joined to a release liner by an adhesive with adjacent relatively low and high release bonds. The high release bond secures the label to the liner, and the low release bond permits easy removal therefrom.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 7 is plan view of a portion of the liner illustrated in FIG. 1 in accordance with another embodiment of the present invention.

FIG. 8 is a portion of the label sheet illustrated in FIG. 1 in accordance with another embodiment of the present invention.

DETAILED DESCRIPTION OF THE INVENTION

Figure 1:
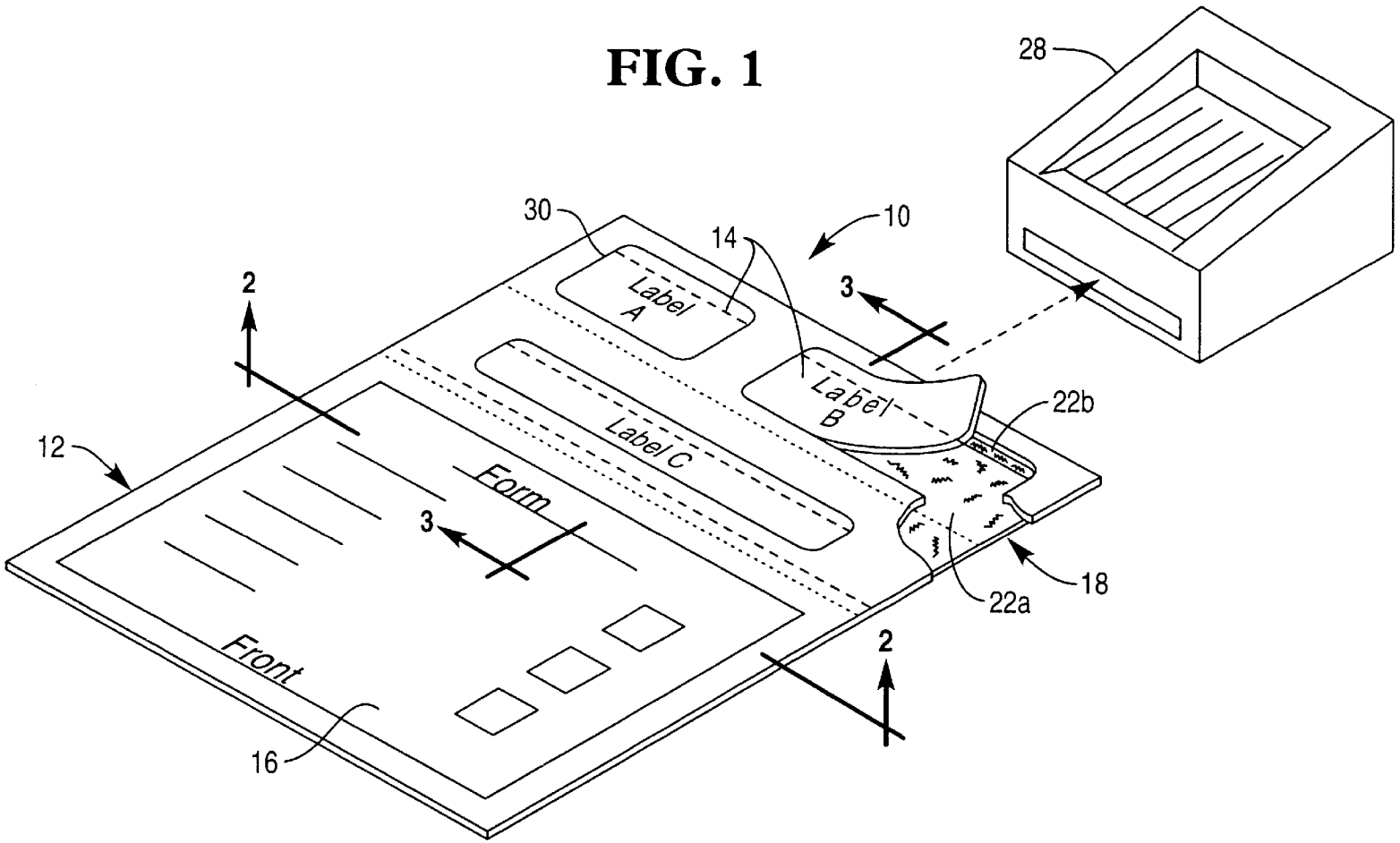
FIG. 1 is an isometric view of the front side of a label sheet in accordance with an exemplary embodiment of the present invention.
Figure 2:
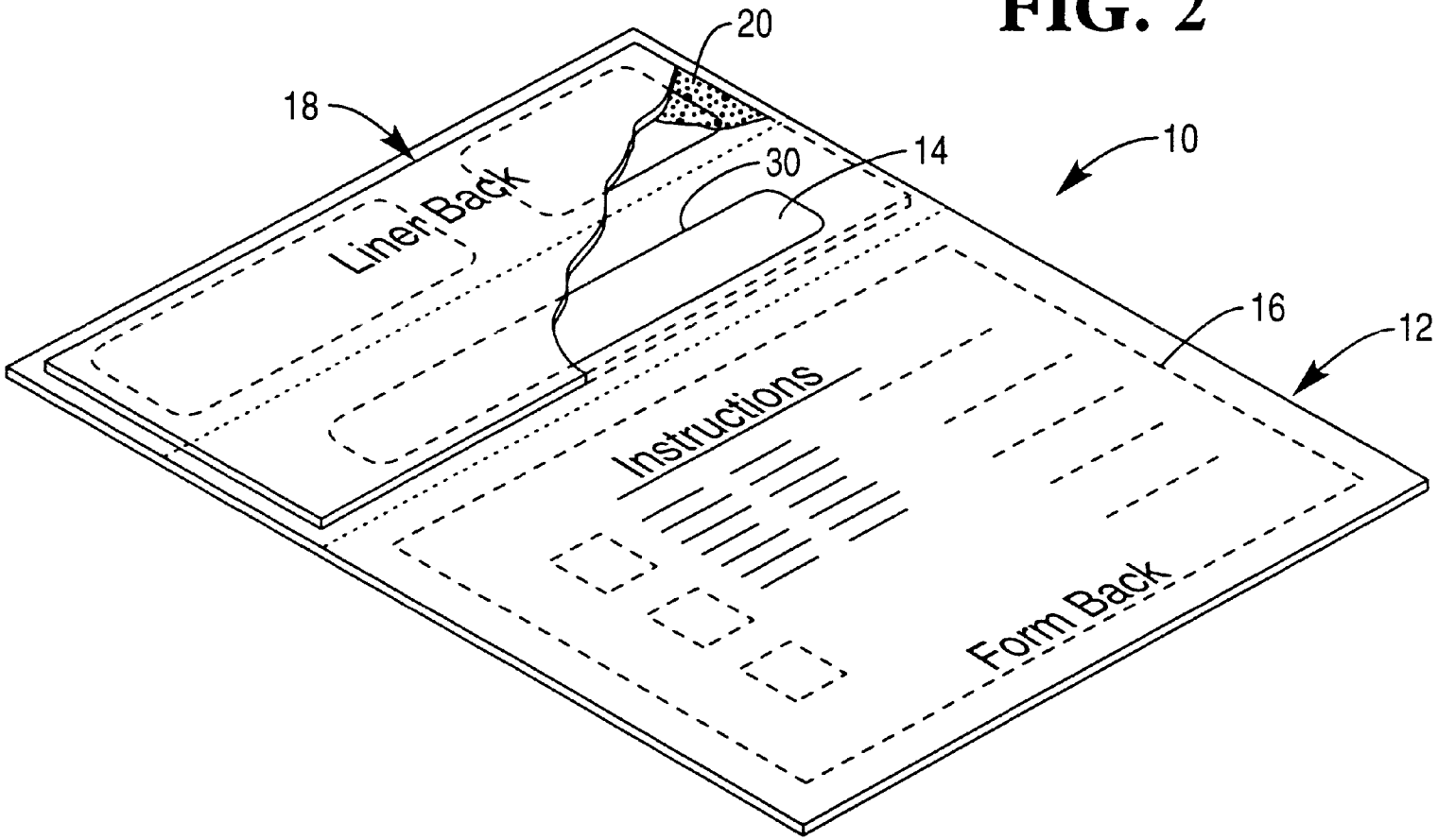
FIG. 2 is an isometric view of the back side of the label sheet illustrated in FIG. 1 and taken along line 2—2.

Illustrated in FIGS. 1 and 2 is a label sheet or laminate 10 in accordance with an exemplary embodiment of the present invention. The sheet 10 includes a face sheet or overlay 12 which is preferably a single rectangular paper sheet although it may have other composition and configuration as desired. The overlay includes a front or outer side which may be printed upon or preprinted, and an opposite inner or back side. The overlay also includes one or more individual removable labels 14, and may optionally include a form portion 16 which may be printed front and back.

The label portion of the overlay is laminated to an underlying release liner 18 which includes an inner or front side that faces the overlay back, and an opposite outer or back side. The overlay 12 is illustrated in sectional view in FIG. 3 laminated to the liner 18, with the liner being shown in isolation in FIG. 4.

Figure 3:
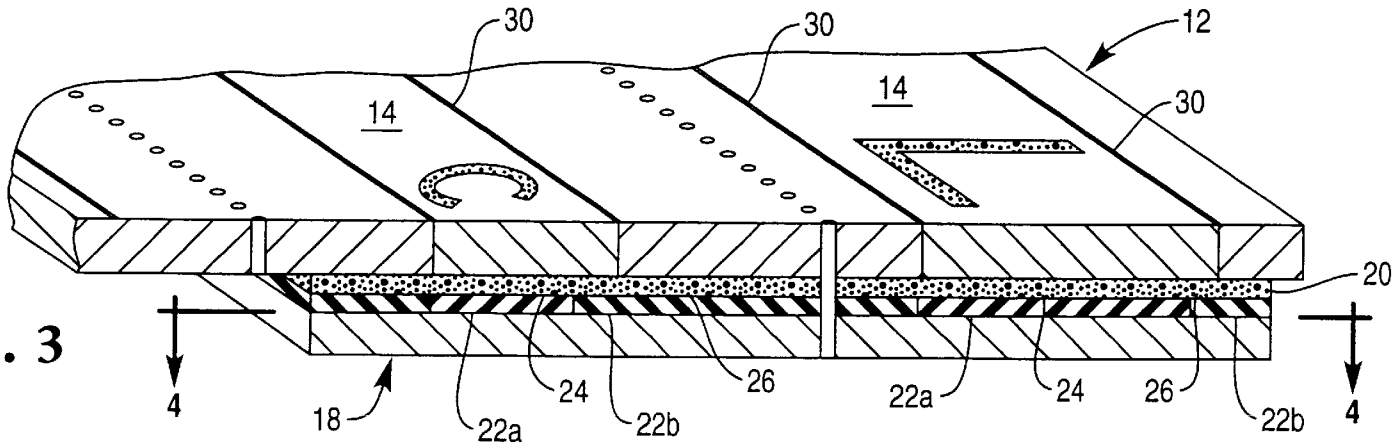
FIG. 3 is a sectional view through a portion of the label sheet illustrated in FIG. 1 and taken along line 3—3.

As shown in FIGS. 2 and 3, an adhesive 20 is bonded to the label portion of the overlay and removably bonds together the individual labels 14 and the liner 18 in a laminated construction for allowing individual labels 14 to be removed from the liner and then affixed to a paper sheet, container, or other article as desired in either permanent or temporary bonds.

The individual labels are rendered removable without damage thereto by applying an integral release coating, designated by the prefix 22, over the front side of the liner 18 for selectively controlling the bonding thereto by the adhesive 20. Release coatings are conventional and include for example a liquid silicone which is applied wet to the liner and then cured using ultraviolet light or heat for example. As indicated above, a conventional release liner includes a single release coating having the same release characteristics over its entire surface area since the liners are typically manufactured in large rolls and cut to size for specific applications.

In accordance with the present invention, the adhesive 20 removably bonds together the labels 14 and liner 18 in adjacent relatively low and high release joints or bonds 24,26, respectively, as initially illustrated in FIG. 3. The low release bond 24 has a relatively low release force which allows the portion of the label thereabove to be easily peeled away from the underlying liner. The high release bond 26 requires a relatively high release force for allowing the portion of the liner thereabove to be peeled away with a substantially greater removal force than that needed for the low release bond 24. In this way, the individual labels 14 have preferential or selective release bonds for maintaining the integrity of the label sheet 10 during printing thereon, yet also allowing the easy removal of individual labels.

More specifically, FIG. 1 illustrates an exemplary laser printer 28 which conventionally includes a hot fusion roller therein and narrow guide rollers along which individual label sheets 10 are guided for printing thereon. The label sheet 10 may have any suitable configuration specifically configured for travel through the exemplary laser printer 28, or other forms of printers as desired. In all cases, the label sheet 10 is fed into the printer with its leading edge first entering the printer, and its trailing edge last entering the printer. In FIG. 1, the sheet leading edge is at the top of the sheet with the trailing edge being at the bottom of the sheet. The leading and trailing edges are, of course, dependent upon the specific configuration of the label sheet and the intended feed direction in the corresponding printer. Various label sheets may be either fed top first, bottom first, or sideways as desired, with the first edge entering the printer being the leading edge by definition.

In the exemplary embodiment illustrated in FIGS. 1 and 2, a plurality of the labels 14 are disposed in a common overlay 12 and bonded atop the liner 18. Each label 14 includes a corresponding perimeter 30 which is preferably defined by a continuous diecut through the overlay down to the liner. The diecuts define the perimeter edges of the individual labels, and allow the individual labels to be removed from the remaining portion of the overlay and from the supporting liner 18. Although three exemplary labels A,B,C are illustrated, the invention may be applied to a single label or any number of labels in any configuration as desired for removing individual labels.

Like the label sheet 10 itself, the individual labels 14 also include a leading edge which first enters the printer 28 illustrated in FIG. 1 followed in turn by corresponding trailing edges of the labels, again defined by the relative travel of the individual labels into the printer 28. The relative travel of the labels is significant in the present invention because it is desired to prevent predispensing of the individual labels inside the printer 28 due to the heat and tight bends therein, while also allowing the subsequent easy removal of individual labels manually when desired.

Since the bending of the label sheet in its travel through the printer 28 will tend to first lift and separate the leading edges of the various labels from the underlying liner, the high release bond 26 preferably extends along the leading edge of the individual labels to prevent predispensing thereof.

Correspondingly, the low release bond 24 illustrated in FIG. 3 extends along a different portion of the diecut perimeter including, for example, the label trailing edges. In this way, the label leading edge may be bonded to the liner with a high release force bond selected to prevent predispensing of the label during its travel through the laser printer 28. And, the trailing edge of the individual labels may be bonded to the liner with a low release force bond for allowing the label to be easily peeled away from the liner manually when desired. Once a portion of the label is peeled away from the liner, the remaining portion of the label will readily follow notwithstanding the higher release force securing it thereto. In this way, the label sheet 10 may enjoy the benefits of both the high release bond along the leading edges of the labels for preventing predispensing in the printer, while nevertheless being easily removed from the liner when desired by initiating peeling at any portion of the low release force bond.

Since the low and high release bonds 24,26 are created or effected by the combination of the adhesive 20 joined to the back of the labels 14, and the release coating 22 joined to the front of the liner 18, the different release forces for the two bonds may be effected by varying either adhesion of the adhesive 20, or by varying adhesion of the release coating 22.

In the exemplary embodiment illustrated in FIG. 1, the individual labels 14 are rectangular in configuration and have a perimeter defined by four connected straight edges. As shown in FIG. 3, the high release bond 26 includes at least one of the perimeter edges such as the leading edge as described above for preventing predispensing in the printer. And, the low release bond 24 also includes at least one of the perimeter edges, but preferably different than the high release bond edge.

Figure 4:
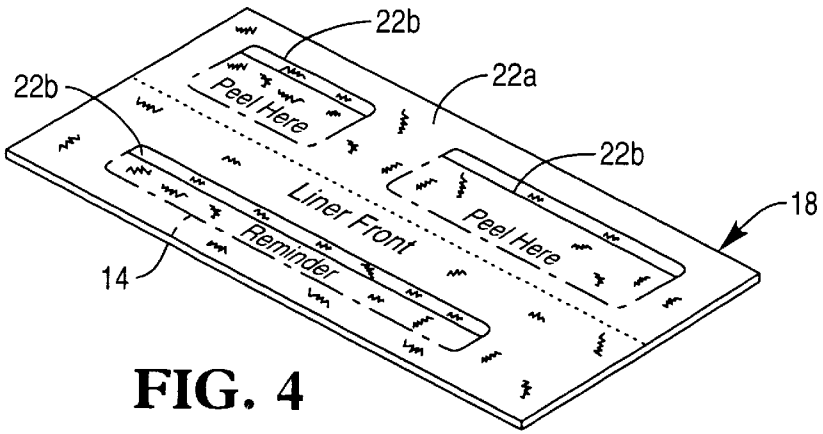
FIG. 4 is an isometric view of the front side of the liner illustrated in FIG. 3 and taken along line 4—4.

In a simple embodiment, as illustrated in FIG. 4, the high release bond 26 is effected by using a high release coating 22*b* on the liner 18 which need extend along only a single one of the label edges, such as the leading edge. The low release bond 24 is effected by using a low release coating 22*a* extending at least along the remaining three edges of the individual labels, and, for example covers the entire liner surface except below the label leading edges.

The high release bond effected by the high release coating 22*b* preferably extends in a narrow band only along the single leading edge of the label, and the low release bond effected by the low release coating 22*a* extends completely between the remaining three edges. The adhesive 20 under the individual label 14 has a single composition and adhesion force.

In the first embodiment illustrated in FIGS. 1–4, the front side of the liner 18 primarily includes the low release coating 22*a,* with narrow bands of the high release coating 22*b* being selectively applied thereto for underlying the corresponding leading edges only of the individual labels 14.

Figure 5:
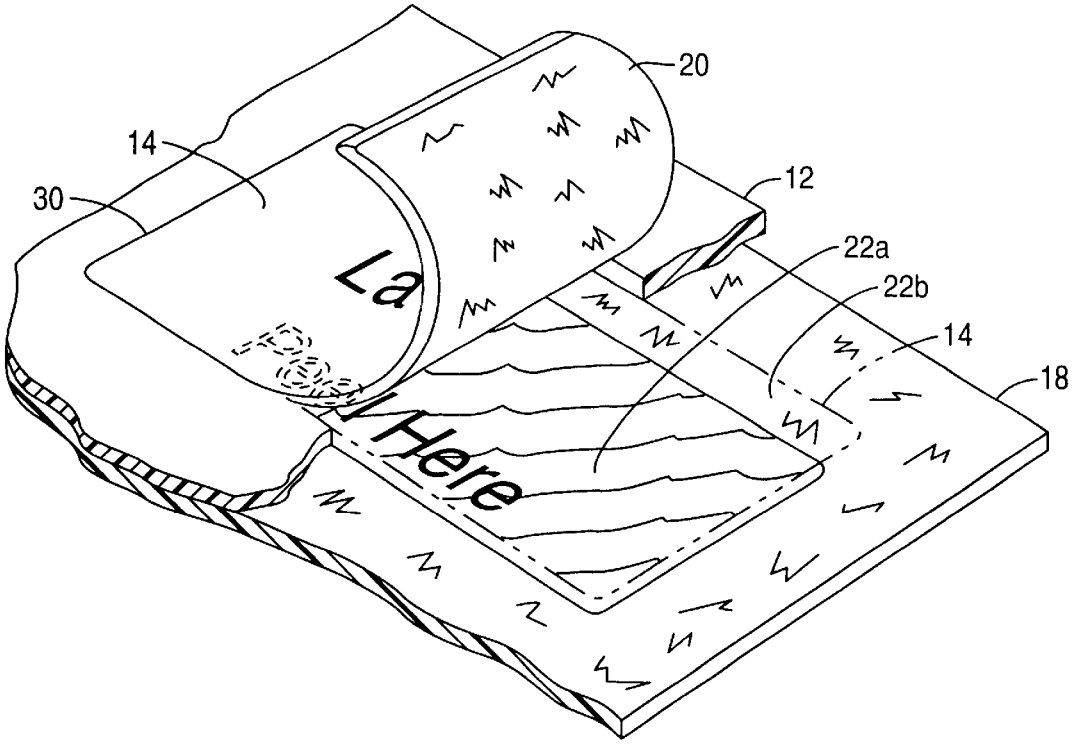
FIG. 5 is an enlarged, isometric view of one of the labels illustrated in FIG. 1 being peeled away from the underlying liner in accordance with an alternate embodiment of the present invention.

FIG. 5 illustrates an alternate embodiment wherein the entire front surface of the liner 18 includes the high release coating 22*b,* except for small patches of the low release coating 22*a* being selectively applied to underlie each label except for its leading edge.

Figure 6:
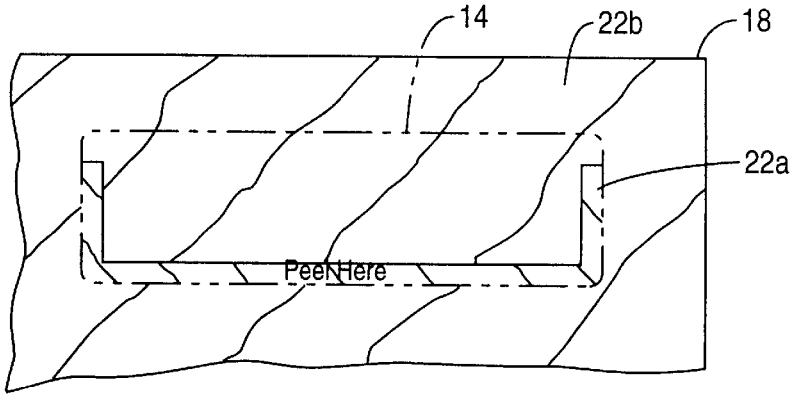
FIG. 6 is a plan view of a portion of the liner illustrated in FIG. 1 in accordance with an another embodiment of the present invention.

FIG. 6 illustrates an alternate embodiment wherein the entire front surface of the liner 18 also includes the high release coating 22*b,* but with small bands of the low release coating 22*a* being selectively applied thereto to correspond with the trailing and side edges of the individual labels to permit easy peeling thereof. In this way, the low release bonds effected by the low release coating 22*a* only border three edges of each label, with the high release bond effected by the high release coating 22*b* extending completely therebetween and including the leading edges of the labels.

In these embodiments, the low release bond covers a majority of the individual labels, and the high release bond 26 covers the remaining minority area of the individual labels. The multiple labels 14 are removably bonded to the common liner 18 at corresponding low and high release bonds 24,26. And, the high release bonds 26 effected by the high release coating 22*b* are similarly disposed along respective perimeters thereof such as the common leading edges.

Also in these embodiments, the overlay 12 includes a border between adjacent ones of the labels 14, and the high release bond 26 extends under the border to ensure that the remaining portion of the overlay remains fixedly attached to the liner 18 after one or more of the individual labels are removed therefrom.

Although the low and high release bonds 24,26 are effected by correspondingly continuous low and high release coatings 22*a,b* along the respective perimeter edges, the coatings may alternatively be interrupted along those edges. As long as a sufficient region of low release bond 24 is provided for each label to initiate manual peeling thereof, the remainder of the label may have a continuous high release bond, or alternating high and low release bonds to ensure label integrity during the printing process.

If desired, the liner 18 as illustrated in FIGS. 5 and 6 may include an instruction to "Peel Here" printed below the trailing edge of the individual label as a reminder of where the label may be readily removed from the liner. This may be accomplished along any edge of the label except the high release bond edge in view of the increased release force required for separating the label from the liner thereat. And, the instruction may be sufficiently dark, and the label slightly transparent for viewing the instruction therethrough.

FIG. 7 illustrates another embodiment of the present invention in which the high release bond effected by the high release coating 22*b* is spaced inwardly from the perimeter edge of the label 14. In this embodiment, the liner 18 may be entirely covered with the low release coating 22*a* except for local patches of the high release coating 22*b* disposed below the individual labels 14. The high release patches 22*b* are suitably recessed from the perimeter of the label so that the label edge may be lifted when desired to initiate the manual peeling thereof. However, the label is otherwise sufficiently secured to the liner by the high release coating 22*b* to prevent predispensing in the printer. The low release border surrounding the individual labels in this embodiment may be as narrow as about a few millimeters.

If desired, the individual labels may directly adjoin each other, without an intervening label border. Upon removal of all labels from the liner, no remaining label material will then remain.

As indicated above, the different release bonds 24,26 are preferably effected by using correspondingly different release coatings 22*a,b*. Suitable release coatings are commercially available from Rhodia, Inc. of Rockhill, S.C., under the trademark Silcolease, PC-600 System. This product is an ultraviolet light (UV) curing silicone system including a silicone polymer, cationic photoinitiator, and release modifier which are mixed together by different weight to tailor the release force of the release coating for use with various adhesives. A premium or easy release coating may be used to effect a low release bond of about 5–30 grams per inch. An intermediate release coating may be used to effect a release bond of about 30–100 grams per inch. And, a tight release coating may be used to effect a high release bond of over 100 grams per inch.

In a preferred embodiment, either the intermediate release or tight release coatings may be used to effect the high release bonds 26 to prevent predispensing in the printer. And, the premium or easy release coating may be used for the low release bond 24 for permitting easy peeling of the labels when desired.

As indicated above, instead of the varying the adhesion characteristics of the release coating, the low and high release bonds may be effected by varying adhesion of the adhesive 20 as illustrated in FIG. 8. In this embodiment, the release coating 22 has a single composition and adhesion force, whereas the label 14 includes a relatively low tack adhesive 20*a* to form the low release bond 24 and a relatively high tack adhesive 20*b* to form the high release bond 26.

The adhesive 20 may be uniformly applied to the back side of the overlay 12 with a single adhesion force for the embodiments illustrated in FIGS. 1–6, or selectively applied thereto for different adhesion forces for the embodiment illustrated in FIG. 8. Correspondingly, the release coating 22 illustrated in FIG. 8 may be applied to the liner 18 uniformly with a single release force. Or, the different release coatings 22*a,b* for the embodiments illustrated in FIGS. 1–6 may be selectively applied to the liner 18 for different release forces. This may be accomplished using a conventional printing press in which the release coating in liquid form is precisely printed atop the liner 18 as required and then cured using ultraviolet light.

As indicated above, the simple introduction of the different regions of low and high release bonds between the overlay 12 and the liner 18 may be effected in various embodiments for enjoying the improved benefits therefrom. The high release bond ensures label sheet integrity and prevents predispensing while traveling through a laser printer. And, the low release bond allows individual labels to be easily peeled away from the liner beginning at any corresponding edge thereof. This in turn substantially increases the ease of use of the label sheet, particularly in the high volume pharmacy industry, and without noticeable visual change in the label sheet itself.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the U.S. is the invention as defined and differentiated in the following claims:

What is claimed is:

1. A label sheet comprising:

a label;

a release liner having a plurality of different release coatings thereon adjoining each other to collectively underlie said label; and an adhesive removably bonding together said label and liner in adjoining relatively low and high release bonds corresponding with said different release coatings, with said adhesive being directly bonded to said release coatings, and said release coatings being directly bonded to said release liner for retention thereto upon removal of said label and adhesive therefrom.

2. A sheet according to claim 1 wherein said label includes a perimeter, and said high release bond extends along an edge thereof.

3. A sheet according to claim 2 said low release bond extends along an edge of said perimeter.

4. A sheet according to claim 3 wherein said high release bond includes said perimeter edge thereat.

5. A sheet according to claim 3 wherein said high release bond is spaced inwardly from said perimeter edge thereat.

6. A sheet according to claim 3 wherein said low release bond includes said perimeter edge thereat.

7. A sheet according to claim 3 wherein said high release bond is continuous along said edge thereat.

8. A sheet according to claim 3 wherein said low release bond is continuous along said edge thereat.

9. A sheet according to claim 3 wherein said low release bond covers a majority of said label, and said high release bond covers a minority of said label.

10. A sheet according to claim 9 wherein said label is rectangular with four edges, and said high release bond extends along one of said edges, and said low release bond extends along the remaining three edges.

11. A sheet according to claim 10 wherein said high release bond extends only along said one edge, and said low release bond extends completely between said remaining three edges.

12. A sheet according to claim 10 wherein said low release bond only borders said three edges, and said high release bond extends completely therebetween.

13. A sheet according to claim 3 further comprising a plurality of said labels removably bonded to said liner at corresponding low and high release bonds.

14. A sheet according to claim 13 wherein said high release bonds for said labels are similarly disposed along respective perimeters thereof.

15. A sheet according to claim 14 wherein:

said labels are disposed in a common overlay atop said liner;

said label perimeters are defined by diecuts through said overlay; and said low and high release bonds extend along different portions of diecuts.

16. A sheet according to claim 15 wherein said overlay further includes a border between adjacent ones of said labels, and said high release bond extends under said border.

17. A sheet according to claim 3 wherein said label includes a leading edge for first entering a printer, and said high release bond is disposed along said leading edge.

18. A label sheet comprising;

a label;

a release liner having a release coating thereon; and a plurality of different adhesives adjoining each other to collectively coat said label for removably bonding together said label and liner in adjoining relatively low and high release bonds corresponding with said different adhesives, and wherein said different adhesives are directly bonded to said release coating.

19. A sheet according to claim 8 wherein said label includes a perimeter, and said high release bond extends along an edge thereof.

20. A pharmaceutical label sheet for printing information thereon in a laser printer comprising;

a release liner having a release coating thereon;

an overlay including a plurality of pharmaceutical labels overlaying said liner, and with a leading edge for first entering said printer, and with a front side for being printed with pharmaceutical information in said printer;

an adhesive uniformly covering back sides of said labels, and cooperating with said release coating to removably bond each of said labels to said liner in adjoining relatively low and high release bonds collectively underlying each of said labels, with said high release bonds extending along corresponding leading edges of said labels for firstly entering said printer, said adhesive being directly bonded to said release coating, and said release coating being directly bonded to said liner for retention thereto upon removal of said labels and adhesive therefrom.

21. A sheet according to claim 20 further comprising a plurality of different release coatings on said release liner having different release forces corresponding with said low and high release bonds.

22. A sheet according to claim 20 further comprising a plurality of different adhesives collectively covering said label back sides and having different adhesion forces corresponding with said low and high release bonds.

* * * * *